US006734417B2

(12) United States Patent
Vejtasa

(10) Patent No.: US 6,734,417 B2
(45) Date of Patent: May 11, 2004

(54) DISPLACEMENT MEASUREMENT SYSTEM AND SHEET FEED SYSTEM INCORPORATING THE SAME

(75) Inventor: David S. Vejtasa, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/142,392

(22) Filed: May 8, 2002

(65) Prior Publication Data

US 2003/0209657 A1 Nov. 13, 2003

(51) Int. Cl.[7] ..... G01D 5/34; G01N 21/86; H03M 1/22; B65H 7/02; B07C 5/08

(52) U.S. Cl. ..... 250/231.13; 250/559.27; 341/11; 341/13; 271/265.04; 209/604

(58) Field of Search ..... 250/231.13, 231.14, 250/231.15, 221, 559.27, 237 R, 237 G, 234, 235; 341/11, 13; 356/630; 271/262, 265.04

(56) References Cited

U.S. PATENT DOCUMENTS 3,973,825 A * 8/1976 Starkweather
4,121,716 A * 10/1978 Luperti
4,378,109 A 3/1983 Takahashi et al.
4,420,747 A 12/1983 Kistner
4,550,252 A * 10/1985 Tee
4,603,848 A 8/1986 Markgraf et al.
4,879,513 A 11/1989 Spiegel et al.
5,026,035 A 6/1991 Martinez Sanz et al.
5,203,555 A 4/1993 Cannaverde et al.
5,204,537 A * 4/1993 Bennet et al.
5,678,678 A 10/1997 Brandt, Jr. et al.
5,806,992 A * 9/1998 Ju

* cited by examiner

*Primary Examiner*—David Porta
*Assistant Examiner*—David C. Meyer

(57) ABSTRACT

A displacement measurement system and a sheet feed system incorporating the same are described. The displacement measurement system includes a support arm, a roller, and an optical encoder. The support arm has a first end and a second end and is configured to turn about a pivot axis on a pivot located closer to the first end than the second end so that displacement of the first end causes a greater corresponding displacement of the second end. The roller is mounted at the first end of the support arm and is configured to rotate about a roller axis substantially parallel to the pivot axis. The optical encoder has at least one component mounted at the second end of the support arm and is configured to generate signals responsive to movement of the second end of the support arm.

24 Claims, 2 Drawing Sheets

DISPLACEMENT MEASUREMENT SYSTEM AND SHEET FEED SYSTEM INCORPORATING THE SAME

TECHNICAL FIELD

This invention relates to displacement measurement systems and sheet feed systems incorporating the same.

BACKGROUND

Sheet feed systems typically include sheet feed detectors that produce an output having a value that increases with the thickness of sheet layers being fed. Such sheet feed detectors may include mechanical sensors that detect the thickness of the sheet layer, capacitor circuits in which the sheet layer forms the dielectric, and radiation generators and detectors that measure the absorption of photons, electrons, or ions by the sheet layer. The responses of such sheet feed detectors correspond mechanical displacements or electrical signals that may be compared to stored reference values. The result of the comparison typically is a is binary electrical signal that may be used to stop the sheet feed mechanism if the measured thickness is greater than the reference value. A simple mechanical system may use a single micro-switch. An electrical system may use a comparator to drive a relay.

U.S. Pat. No. 4,420,747 has proposed a system for detecting missing or superimposed sheets fed to a sheet processing machine that uses a measuring device to generate a signal that increases with the number of superimposed sheets and an evaluating device that emits an electrical signal when irregularities occur. A pulse transmitter is synchronized to the sheet feed mechanism and operates to emit an initial pulse and a final pulse that are timed to the sheet feed. Electronic storage is reset upon the initial pulse, and operates to integrate values of the measured signal until the final pulse is received. Upon receipt of the final pulse, the stored value is compared to a reference value to detect any irregularities. Preferably, a microcomputer is used for signal processing.

SUMMARY

The invention features a displacement measurement system, comprising a support arm, a roller, and an optical encoder. The support arm has a first end and a second end and is configured to turn about a pivot axis on a pivot located closer to the first end than the second end so that displacement of the first end causes a greater corresponding displacement of the second end. The roller is mounted at the first end of the support arm and is configured to rotate about a roller axis substantially parallel to the pivot axis. The optical encoder has at least one component mounted at the second end of the support arm and is configured to generate signals responsive to movement of the second end of the support arm.

The invention also features a sheet feed system, comprising the above-described displacement measurement system, a sheet feed surface, a biasing member, and a controller. The sheet feed surface is disposed adjacent to the roller and is configured to receive a sheet between the sheet feed surface and the roller. The biasing member is coupled to the support arm at a location between the pivot axis and the second end of the support arm and is configured to urge the roller against the sheet feed surface. The controller is configured to sample signals generated by the optical encoder and to compute one or more displacement values based upon one or more sampled signals.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments nor relative dimensions of the depicted elements, and are not drawn to scale.

Figure 1:
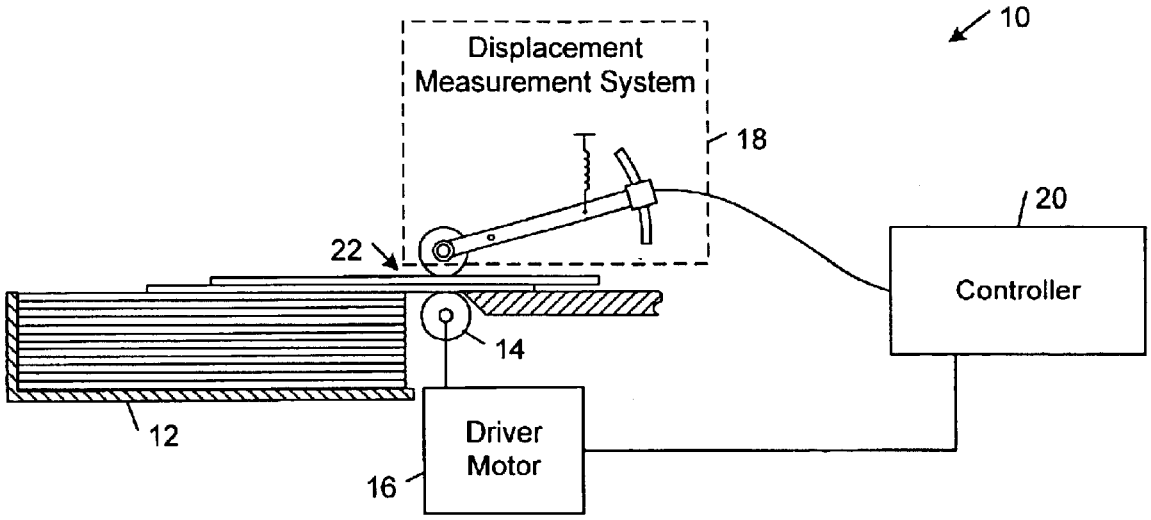
FIG. 1 is a diagrammatic side view of a sheet feed system of a high-speed printing press that includes a displacement measurement system.

Referring to FIG. 1, in one embodiment, a sheet feed system 10 of a high-speed printing press includes a sheet dispenser 12, a drive roller 14 coupled to a drive motor 16, a displacement measurement system 18, and a controller 20. Sheet dispenser 12 may include a conventional sheet feed mechanism to feed sheets to the drive roller 14. Drive roller 14 and drive motor 16 may be implemented as conventional components commonly found in high-speed printing presses. As explained in detail below, while a sheet layer 22 is being fed over drive roller 14, displacement measurement system 18 is configured to rapidly generate multiple signals from which controller 20 may accurately compute the thickness of sheet layer 22. Based upon the computed sheet layer thickness, controller 20 is operable to detect multiple or missing sheets or some other error condition and to generate other signals for controlling other components of the printing press (e.g., signals controlling precision alignment of mechanical components, such as the pressure or displacement between transfer drums).

Controller 20 preferably is configured to sample the signals generated by displacement measurement system at a high rate (e.g., on the order of 100 kilo-samples per second) so that controller 20 may accurately detect an error condition after only a minor portion (e.g., the first 1–5 cm of a sheet) of a sheet has been fed over drive roller 14. As a result, controller 20 may rapidly generate a sheet feed error signal, which may control a gate directing incorrectly fed sheets down a sheet misfeed path or may shut down the sheet feed system or trigger some other corrective response. In addition, controller 20 may rapidly generate other signals for controlling other components of the printing press. In this way, displacement measurement system 18 may be deployed advantageously in compact printing presses that operate at high speeds (e.g., on the order of 60 meters per minute), such as an HP Indigo® digital printing press, which is available from Hewlett-Packard Company of Palo Alto, Calif., U.S.A.

Figure 2:
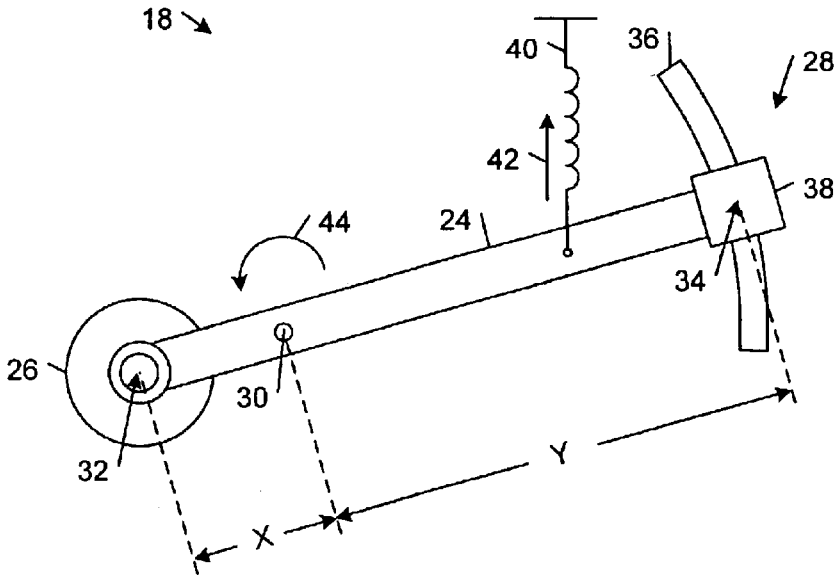
FIG. 2 is a diagrammatic side view of the displacement measurement system of FIG. 1.

As shown more clearly in FIG. 2, displacement measurement system 18 includes a support arm 24, a roller 26 (e.g., a metal bearing), and an optical encoder 28. Support arm 24 preferably is formed from a rigid material and, in some embodiments, support arm 24 is in the form of an I-beam to reduce the magnitude of vibrations that introduce noise in the signals generated by optical encoder 28. Support arm 24 has a first end 32 at which roller 26 is mounted and a second end 34 at which at least one component of optical encoder 28 is mounted. In some embodiments, optical encoder 28 includes an arcuate optical grating 36 mounted at the second end 34 of support arm 24 and an encoder module 38 that include at least one light emitter and light detector pair configured to respectively transmit light to optical grating 36 and to detect light transmitted through optical grating 36. In one embodiment, encoder module 28 is implemented as a conventional 600 dots per inch (dpi) quadrature encoder. Encoder module 38 preferably is fixed to a wall of the displacement measurement system housing or to some other surface so as to be able to detect relative motion of optical grating 36.

Support arm 24 is mounted on a pivot 30 that is located closer to the first end 32 than the second end 34 (i.e., X<Y) so that displacement of the first end 32 causes a greater corresponding displacement of the second end 34. As a result, support arm 24 mechanically increases the resolution of optical encoder 28 by a factor of Y/X. In this way, a relatively inexpensive optical encoder with a resolution that is insufficient to accurately measure sheet thickness may be used in the present application simply by appropriate selection of the distances X and Y. For example, in one embodiment, the resolution of a 600 dpi optical encoder is increased mechanically by a factor of four (i.e., to 2,400 dpi) by a support arm 24 with a ratio Y:X=4:1.

In the illustrated embodiment, displacement measurement system 18 also includes a biasing member 40 (e.g., a spring) that is coupled to support arm 24 at a location between pivot 30 and the second end 34. Biasing member 40 applies a force on support arm 24 in the direction of arrow 42 so as urge support arm 24 to rotate about the pivot axis in the direction of arrow 44 and, thereby, urge roller 26 toward drive roller 14 (see FIG. 1). In this way, displacement of roller 26 away from drive roller 14 caused by an interposing sheet layer 22 will accurately track the thickness of the interposing sheet layer 22. The force applied to support arm 24 by biasing member 40 should be selected based upon several considerations, including the need for a quick response (suggesting a higher bias force) and the amount of noise generated when the leading edge of a sheet is fed between roller 26 and drive roller 14 (suggesting a smaller bias force). In some embodiments, a conventional shock absorber may be coupled in series with biasing member 40 to reduce the sensitivity of displacement measurement system 18 to the introduction of the leading edge of each sheet between roller 26 and drive roller 14.

Figure 3:
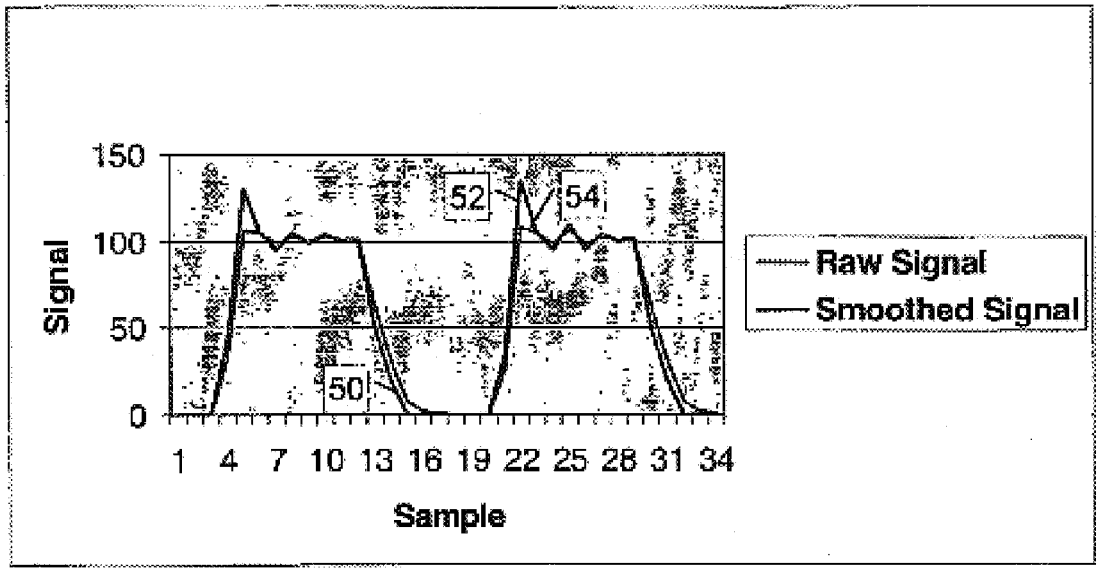
FIG. 3 is a graph of signals generated by the displacement measurement system of FIG. 1 and smoothed versions of the same signals plotted as a function of sample number.

As shown in FIG. 3, the raw signal values 50 that are sampled by controller 20 from optical encoder 28 typically contain noise and other artifacts, including an overshoot spike 52 corresponding to the times when roller 26 contacts the leading edge of each sheet that is fed through the system. The raw signals 50 may be smoothed using one or more signal processing techniques, including one or more smoothing filters. For example, in one embodiment, raw signal values 50 are smoothed by a smoothing filter that adds a percentage (e.g., 25%) of a previous reading to a complementary percentage (e.g., 75%) of current reading to produce smoothed signal values 54. The parameters of the smoothing filter should be selected based upon a number of criteria, including the sampling rate. In general, the amount of smoothing should increase with the sampling rate.

Figure 4:
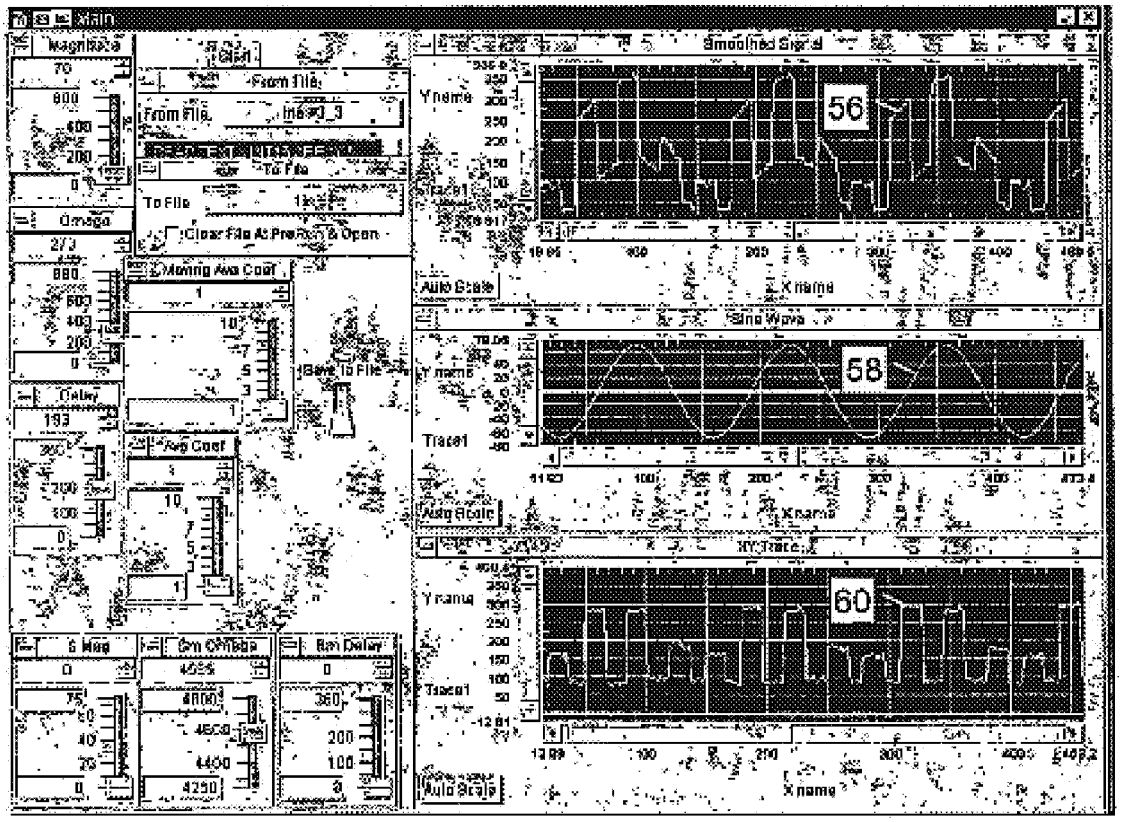
FIG. 4 is a graphical user interface containing graphs of multiple signals plotted as a function of time.

As shown in FIG. 4, some raw signal values 56 also may contain periodic artifacts that may be caused by deviations from a perfectly circular rotation of the cylindrical driver roller 14, such as drum run-out. In some embodiments, controller 20 may be operable to remove such artifacts. For example, controller 20 may be programmed to apply a Fast Fourier Transform (FFT) to the raw signal values 56 to obtain a best-fit sine wave signal 58, which then may be subtracted from the raw signal values 56 to obtain a set of artifact-cleansed signal values 60.

After the raw optical encoder signals sampled by controller 20 have been smoothed and after any artifacts have been removed, the resulting signal values may be averaged to improve the accuracy of the thickness measurement for each sheet. The number of signals that are averaged depends upon the sampling rate and the amount of time after the leading edge of each sheet has been fed over drive roller 14 before controller 20 must take some action (e.g., detect an error condition or transmit the thickness measurement to one or more components of the printing press system). In some embodiments, the number of averaged signals corresponds to signals obtained from measurements over an initial minor portion (e.g., the first 1–5 cm) of each sheet. Averaging multiple thickness measurement values improves the accuracy of the final thickness value obtained for each sheet and improves the resolution of the thickness measurements because the noise inherent in the system produces small variations in the digital optical encoder signals that on average converge to the actual thickness.

In one embodiment, controller 20 is implemented as a programmable microcontroller (e.g., a PIC 16F84 microchip flash microcontroller available from Microchip Technology, Inc. of Chandler, Ariz. U.S.A.) or a programmable logic device.

Other embodiments are within the scope of the claims. Although displacement measurement system 18 has been configured to measure sheet layer thicknesses in the above-described embodiments, displacement measurement system 18 also may be deployed in other locations of an imaging system. For example, in one implementation, displacement measurement system 18 may be disposed adjacent to an imaging or inking drum and used to monitor the performance of the drum (e.g., whether there is any significant drum run-out or damage to the drum).

The thickness measurement and signal processing systems and methods described herein are not limited to any particular hardware or software configuration, but rather they may be implemented in any computing or processing environment, including in digital electronic circuitry or in computer hardware, firmware or software. These systems and methods may be implemented, in part, in a computer program product tangibly embodied in a machine-readable storage device for execution by a computer processor. In some embodiments, these systems and methods preferably are implemented in a high level procedural or object oriented programming language; however, the algorithms may be implemented in assembly or machine language, if desired. In any case, the programming language may be a compiled or interpreted language. The thickness measurement and signal processing methods described herein may be performed by a computer processor executing instructions organized, e.g., into program modules to carry out these methods by operating on input data and generating output. Suitable processors include, e.g., both general and special purpose microprocessors. Generally, a processor receives instructions and data from a read-only memory and/or a random access memory. Storage devices suitable for tangibly embodying computer program instructions include all forms of non-volatile memory, including, e.g., semiconductor memory devices, such as EPROM, EEPROM, and flash memory devices; magnetic disks such as internal hard disks and removable disks; magneto-optical disks; and CD-ROM. Any of the foregoing technologies may be supplemented by or incorporated in specially-designed ASICs (application-specific integrated circuits).

Still other embodiments are within the scope of the claims.

What is claimed is:

1. A displacement measurement system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis; and an optical encoder having an optical grating mounted at the second end of the support arm and configured to generate signals responsive to movement of the second end of the support arm.

2. The system of claim 1, wherein the optical grating is arcuate in shape.

3. The system of claim 1, wherein the optical encoder further comprises a light emitter configured to transmit light to the optical grating and a light detector configured to detect light transmitted through the grating.

4. A displacement measurement system, comprising:

a support arm having a first end and a second end and configured to turn about a pivot axis on a pivot located closer to the first end than the second end so that displacement of the first end causes a greater corresponding displacement of the second end, wherein the support arm comprises an I-beam;

a roller mounted at the first end of the support arm and configured to rotate about a roller axis substantially parallel to the pivot axis; and an optical encoder having at least one component mounted at the second end of the support arm and configured to generate signals responsive to movement of the second end of the support arm.

5. The system of claim 1, further comprising a biasing member coupled to the support arm at a location between the pivot axis and the second end of the support arm and configured to urge the roller against a surface.

6. The system of claim 1, further comprising a controller configured to sample signals generated by the optical encoder and to compute one or more displacement values based upon one or more sampled signals.

7. The system of claim 6, wherein the controller is operable to compute average displacement values based upon respective sets of multiple signals.

8. A displacement measurement system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

an optical encoder having at least one component mounted at the second end of the support arm and configured to generate signals responsive to movement of the second end of the support arm; and a controller configured to sample signals generated by the optical encoder and to compute one or more displacement values based upon one or more sampled signals, wherein the controller is operable to smooth sampled signals.

9. A displacement measurement system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

an optical encoder having at least one component mounted at the second end of the support arm and configured to generate signals responsive to movement of the second end of the support arm; and a controller configured to sample signals generated by the optical encoder and to compute one or more displacement values based upon one or more sampled signals, wherein the controller is operable to remove periodic artifacts from sampled signals.

10. The system of claim 6, further comprising a sheet feed surface disposed adjacent to the roller and configured to receive a sheet between the sheet feed surface and the roller.

11. The system of claim 10, wherein the sheet feed surface corresponds to an exposed cylindrical surface of a drive roller.

12. A displacement measurement system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

an optical encoder having at least one component mounted at the second end of the support arm and configured to generate signals responsive to movement of the second end of the support arm;

a sheet feed surface disposed adjacent to the roller and configured to receive a sheet between the sheet feed surface and the roller, wherein the sheet feed surface corresponds to an exposed cylindrical surface of a drive roller; and a controller configured to sample signals generated by the optical encoder and to compute one or more displacement values based upon one or more sampled signals, wherein the controller is operable to remove from sampled signals artifacts caused by deviations from a perfectly circular rotation of the cylindrical drive roller surface.

13. A displacement measurement system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

an optical encoder having at least one component mounted at the second end of the support arm and configured to generate signals responsive to movement of the second end of the support arm;

a sheet feed surface disposed adjacent to the roller and configured to receive a sheet between the sheet feed surface and the roller; and a controller configured to sample signals generated by the optical encoder and to compute one or more displacement values based upon one or more sampled signals, wherein the controller is operable to sample multiple signals generated by the optical encoder while an initial minor portion of a sheet is being fed between the sheet feed surface and the roller and to compute an average displacement value from the multiple sampled signals.

14. The system of claim 13, wherein the controller is operable to generate a sheet feed error signal based upon the computed average displacement value.

15. A sheet feed system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

a sheet feed surface disposed adjacent to the roller and configured to receive a sheet between the sheet feed surface and the roller;

a biasing member coupled to the support arm at a location between the pivot axis and the second end of the support arm and configured to urge the roller against the sheet feed surface;

an optical encoder having an optical grating mounted at the second end of the support arm and configured to generate signals responsive to movement of the second end of the support arm; and a controller configured to sample signals generated by the optical encoder and to compute one or more displacement values based upon one or more sampled signals.

16. The system of claim 15, wherein the sheet feed surface corresponds to an exposed cylindrical surface of a drive roller.

17. A sheet feed system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

a sheet feed surface disposed adjacent to the roller and configured to receive a sheet between the sheet feed surface and the roller, wherein the sheet feed surface corresponds to an exposed cylindrical surface of a drive roller;

a biasing member coupled to the support arm at a location between the pivot axis and the second end of the support arm and configured to urge the roller against the sheet feed surface;

an optical encoder having at least one component mounted at the second end of the support arm and configured to generate signals responsive to movement of the second end of the support arm; and a controller configured to sample signals generated by the optical encoder and to compute one or more displacement values based upon one or more sampled signals, wherein the controller is operable to remove from sampled signals artifacts caused by deviations from a perfectly circular rotation of the cylindrical drive roller surface.

18. A sheet feed system, comprising:

a support arm having a first end and a second end and configured to turn about a pivot axis on a pivot located closer to the first end than the second end so that displacement of the first end causes a greater corresponding displacement of the second end;

a roller mounted at the first end of the support arm and configured to rotate about a roller axis substantially parallel to the pivot axis;

a sheet feed surface disposed adjacent to the roller and configured to receive a sheet between the sheet feed surface and the roller;

a biasing member coupled to the support arm at a location between the pivot axis and the second end of the support arm and configured to use the roller against the sheet feed surface;

an optical encoder having at least one component mounted at the second end of the support arm and configured to generate signals responsive to movement of the second end of the support arm; and a controller configured to sample signals generated by the optical encoder and to compute one or more displacement values based upon one or more sampled signals, wherein the controller is operable to sample multiple signals generated by the optical encoder while an initial minor portion of a sheet is being fed between the sheet feed surface and the roller and to compute an average displacement value from the multiple sampled signals.

19. The system of claim 18, wherein the controller is operable to generate a sheet feed error signal based upon the computed average displacement value.

20. The system of claim 18, wherein based upon the computed average displacement value, the controller is operable to generate a signal controlling operation of a component of an imaging system incorporating the sheet feed system.

21. The system of claim 1, wherein the pivot is located substantially closer to the first end of the support arm than the second end of the support arm.

22. The system of claim 15, wherein the pivot is located substantially closer to the first end of the support arm than the second end of the support arm.

23. The system of claim 8, wherein the controller smoothes sampled signals be adding portions of previous readings to respective portions of subsequent readings to produce smoothed signal values.

24. The system of claim 9, wherein the controller removes periodic artifacts from sampled signals based on curves fitted to respective sets of sampled signals.

* * * * *